US005882097A

United States Patent [19]

Kohagen et al.

[11] Patent Number: 5,882,097

[45] Date of Patent: Mar. 16, 1999

[54] STEP TOOL BOX

[75] Inventors: Steven Frederick Kohagen, Waverly; Fred Philip Ritchie, Waterloo; Deonna Jene Fritz, LaPorte City, all of Iowa

[73] Assignee: Waterloo Industries, Inc., Waterloo, Iowa

[21] Appl. No.: 943,057

[22] Filed: Oct. 2, 1997

[51] Int. Cl.[6] ..... A47B 81/00; B65D 85/20

[52] U.S. Cl. ..... 312/235.1; 206/372; 206/373; 206/806; 312/237

[58] Field of Search ..... 206/373, 372, 206/216, 806; D3/274, 905; D6/336, 349, 350; 312/235.1, 235.2, 237, 902; 220/528

[56] References Cited

U.S. PATENT DOCUMENTS

| | | | |
|---|---|---|---|
| D. 276,861 | 12/1984 | Keddie | D6/336 |
| D. 314,472 | 2/1991 | Brantingham et al. | D6/336 X |
| D. 347,527 | 6/1994 | Breen et al. | D6/336 X |
| D. 354,210 | 1/1995 | Dickinson et al. | D6/336 X |
| D. 355,828 | 2/1995 | Dickinson et al. | D6/336 X |
| D. 382,113 | 8/1997 | DuRapau | D3/274 |
| 4,356,916 | 11/1982 | Anglemyer | 206/372 |
| 4,366,998 | 1/1983 | Kaiser | 312/235.1 |
| 4,458,963 | 7/1984 | Keddie | 312/237 |
| 4,460,085 | 7/1984 | Jantzen | 206/373 X |
| 4,744,613 | 5/1988 | Brantingham et al. | 312/235.1 |
| 4,768,651 | 9/1988 | Lanius | 206/373 X |
| 5,011,013 | 4/1991 | Meisner et al. | 206/373 |
| 5,178,295 | 1/1993 | Crumrine et al. | 206/806 X |
| 5,344,339 | 9/1994 | Cheslock . | |
| 5,439,108 | 8/1995 | Lackie | 206/373 |
| 5,503,571 | 4/1996 | Cheslock | 206/377 X |
| 5,518,139 | 5/1996 | Trower et al. . | |
| 5,595,228 | 1/1997 | Meisner et al. | 206/373 X |
| 5,680,932 | 10/1997 | Dickinson et al. | 206/377 |

OTHER PUBLICATIONS

Catalog Page, Waterloo Industries, Craftsman Organizers, SST Tool Box, No. 65086.

Catalog Page, Contico, Tool Storage: A.) Portable Work Box, No. PW1913, B.) Portable Work Box, No. PW1920, C.) One Step Tool Carrier, No. 521, D.) Two Step Tool Carrier, No. 522, and E.) Tuff Tool Chest, No. C9350.

Catalog Page, Rubbermaid, Tool Carriers: Tool Carriers: Power Tool Tote, No. 7709; Caddy, No. 7757; Caddy, No. 7759; Storage Step Stool, No. 7766; and Tool Box, No. 7768.

Catalog Page, Remline, Stand 'N Store Tool Box, #22500.

Catalog Page, Rubbermaid, Step Stool Tool Box, No. 245–2999.

Catalog Page, Rubbermaid, Tool Carriers, Stepstool Utility Box, Part No. 53790WR.

*Primary Examiner*—Bryon P. Gehman
*Attorney, Agent, or Firm*—Banner & Witcoff Ltd.

[57] ABSTRACT

A tool box includes a bin section for receipt of tools, trays and removable containers or compartments. A hinged lid fits onto the bin portion of the tool box and is designed to retain the various containers and trays in position when closed. The area of the lid is enclosed within the profile of the base of the bin to facilitate sitting and standing thereon and to increase stability of the assembly.

15 Claims, 3 Drawing Sheets

18
92
14
94
90
102
96
100
98
68
76
80
78
56
52
64
72
74
70
50
66
54
23
30
46
60
104
62
10
36
40
44
48
36
38
34
42
32
24
22

STEP TOOL BOX

BACKGROUND OF THE INVENTION

This invention relates to a tool box fabricated from molded plastic materials which may be useful in supporting a person or otherwise acting as a support stand as well as a container to store and transport tools and other items.

The use of molded plastic tool boxes or tool carriers having the dual purpose of carrying and storing of tools as well as acting as a support or step to elevate a person or to provide a seat for a person is illustrated in various prior art patents. For example, U.S. Pat. No. 5,503,571 and U.S. Pat. No. 5,344,339 disclose devices of this general nature. One object associated with the design of such a product is to provide a stable support, particularly when one is standing on the carrier or container, as well as a device which will easily store and carry multiple tools. Thus it is desirable to provide a device which has a large bulk storage capacity yet provides an ability to store small parts in multiple organizational compartments. It is with these goals and objects in mind that the present invention was developed.

SUMMARY OF THE INVENTION

Briefly, the present invention comprises a tool box in the form of a lower bin having a generally rectangular bottom wall, opposite end walls connected by upstanding front and back walls. All of the walls project upwardly from the bottom wall and the bottom wall serves as a base for the tool box. The walls define an enclosure in which various compartments are molded for tool storage. Slidable trays may be positioned within a bin with a rim of the lower bin supporting the trays. The tool box further includes a lid which is hinged to the back side wall of the lower bin and which includes a flange that coacts and engages the rim to hold the top lid in position against the lower bin. Latches are provided on the opposite end walls for connecting the lid with the lower bin. A handle is recessed in the top of the lid. The top of the lid has a generally rectangular shape and is positioned within the profile defined by the bottom wall of the lower bin. The front and back side walls of the tool box converge toward one another so that the top has a lesser area than the area of the bottom wall of the lower bin. The wider and optionally longer bottom wall provides a base for supporting the tool box and for adding stability to the box when it is used for standing or sitting.

Thus it is an object of the invention to provide an improved molded plastic tool box construction.

It is a further object of the invention to provide an improved molded tool box construction which includes a full lower bin or bin enclosure for storage of both large and small items and which includes various compartments and trays, some of the trays and compartments being removable.

Yet another object of the invention is to provide a tool box which has a bottom wall or base which has a greater area than the top wall or top of the support lid. This improves the stability of the box which serves as a support for standing or sitting.

Another object of the invention is to provide an improved tool box wherein a latching mechanism holds a lid of the box against or in communication with a bottom or lower bin, and also serves to retain trays within the box in a fixed position.

Another object of the invention is to provide an inexpensive tool box capable of storing large tools as well as small items in various compartments and containers, some of which are removable from the box.

These and other objects, advantages and features of the invention will be set forth in the detailed description which follows.

DESCRIPTION OF THE FIGURES OF THE DRAWING

In the detailed description which follows, reference will be made to the drawing comprised of the following figures.

DESCRIPTION OF THE PREFERRED EMBODIMENT

Figure 1:
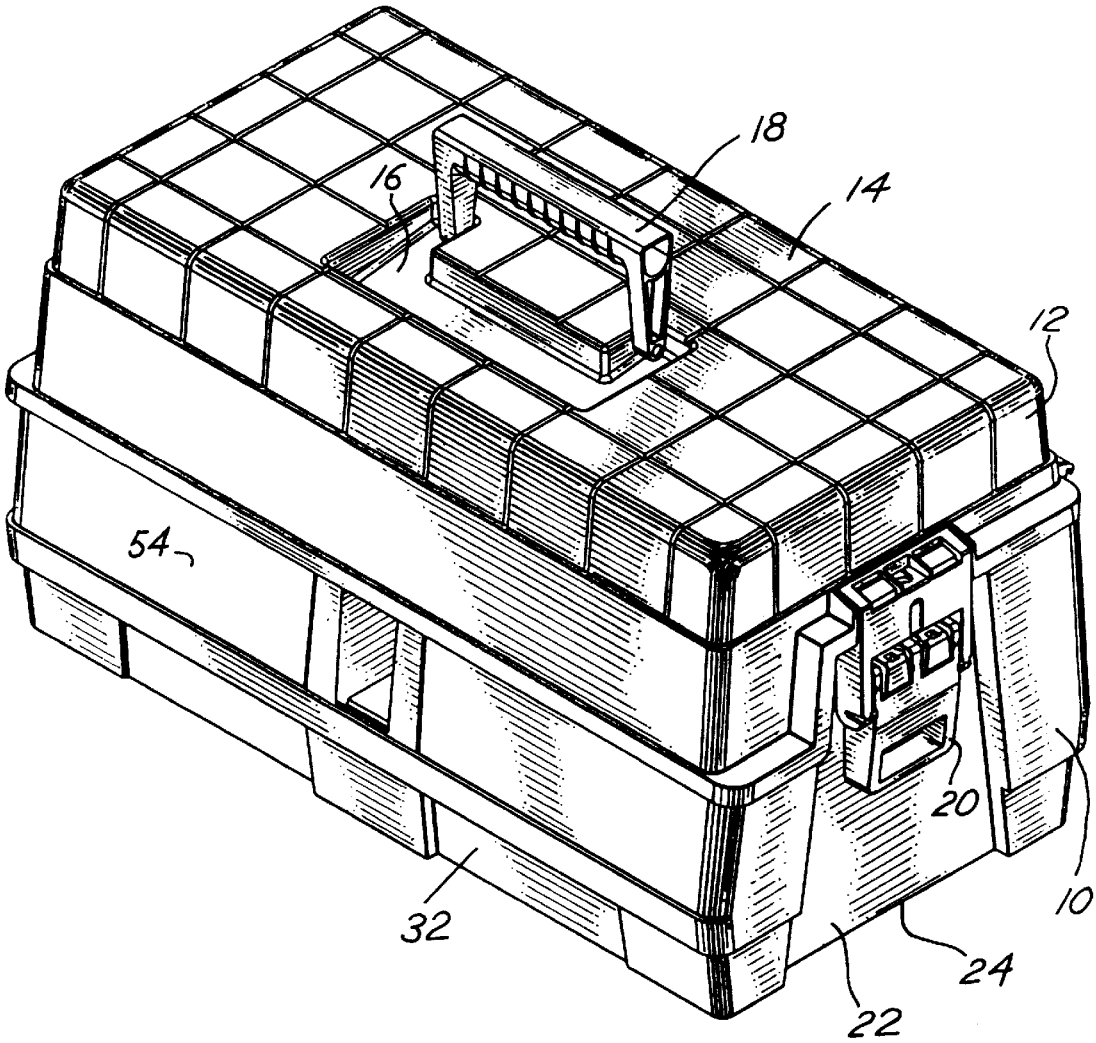
FIG. 1 is an isometric view of the tool box of the invention.
Figure 2:
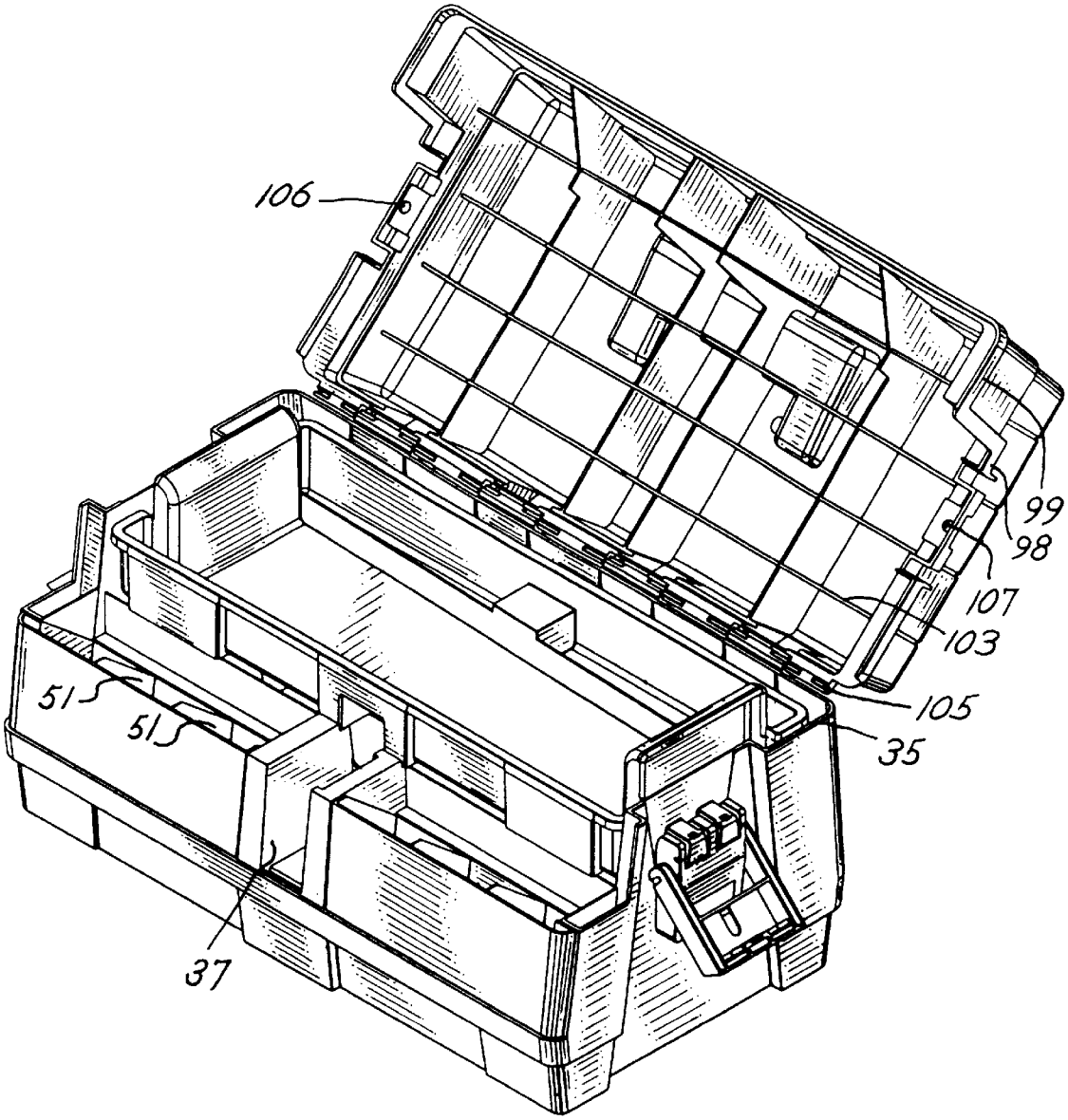
FIG. 2 is an isometric view of the tool box of the invention with the lid in the open position.
Figure 3:
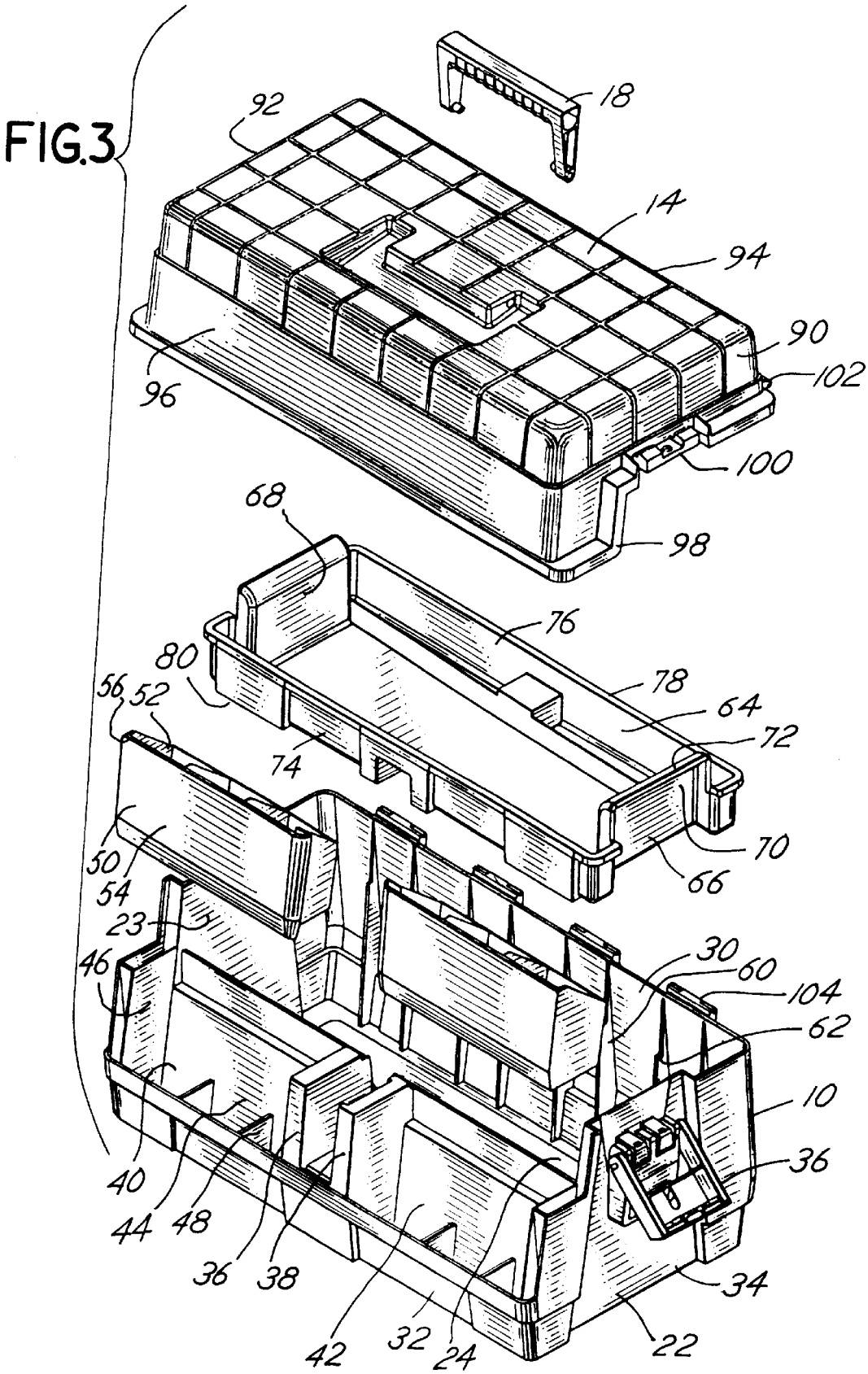
FIG. 3 is an isometric view of the tool box of the invention in an exploded isometric view illustrating the component parts thereof.

Referring first to FIG. 1, there is illustrated in an isometric view, the overall tool box construction of the invention. The tool box includes a lower bin or bin enclosure 10 with a hinged lid or cover 12 attached thereto. The hinged cover 12 includes a top wall or top surface 14 with a recess 16 into which a handle 18 is pivotally attached. The handle 18 fits within the recess 16 when the handle 18 is not being used to carry the tool box. The cover 12 is retained and attached to the bin 10 by means of a latch such as latch 20 associated with each end wall 22 of bin 10. The cross sectional area of the top surface 14 of the lid 12 is less than the cross sectional area or footprint or profile of bottom wall 24 of the bin 10. The top 14 surface fits within the footprint or profile of the bottom wall 24. The top surface 14 is thus supported in generally parallel spaced relation from the bottom wall 24 by means of the side and end walls of the lid 12 and the side and end walls of the bin 10. The side walls of the lower bin 10 converge from the bottom wall 24 toward the top surface 14 as described in greater detail below. The walls top surface 14 and bottom wall 24 form a tool box enclosure.

Referring to the remaining figures, the lower bin 10 includes a back wall 30, a front wall 32, a first end wall 22 and the second end wall 23. The walls 22, 23, 30 and 32 all project upwardly from the bottom wall 24. The bottom wall 24 is planar and forms the inside of the bin 10 in conjunction with the other walls 22, 23, 30 and 32. The side walls 30 and 32 converge toward one another. The end walls 22 and 23 each include a recessed channel, such as recessed channel 34, into which a handle, such as handle 36, is positioned for fastening the lid 12 as described below. The various walls 22, 23, 30 and 32 define a peripheral rim section or rim 35. The rim section 35 for the front wall 32 includes spaced pylons 36 and 38 which define a rectangular opening 37 into the lower bin 10. The rectangular opening 37 is adapted to receive a beam member such as a 2 by 4 or other support member which may be used to carry or may be supported by the tool box of the invention.

The front wall 32 includes a first molded recess 40 and a second molded recess 42. The first recess 40, for example, is defined by a back wall 44, a side wall 46, which is part of the end wall 23, and a pylon 36. Cross members, such as cross member 48, are molded into the first recess 40 to define a bottom or base of the compartment opening defined by the recess 40. The tool box further includes a container such as container 50 which has multiple, article compartments 51 defined therein. The container 50 is a separate molded container 50 and more than one such container 58 may be utilized in the tool box. The container 50, as depicted in the figures, has a configuration which enables it to fit within the first recess 40 and be supported by the cross members or brackets 48. The container 50 includes a front wall 54 which converges toward the lid 12. The container 50 further includes a rim or edge of front wall 54, namely a rim or edge 56 which helps define the rim section or circumferential or peripheral rim 35 associated with a bin 10. Note again that the wall 54 is a converging wall so that the area of the lid 14 is less than the area of the bottom wall 24 and further so that the profile of the lid 14 fits within the profile of the wall 24.

The back wall 30 of the bin 10 includes molded, inner reinforcing ribs 60 which are vertical on the inside of back wall 30. The ribs 60 include a series of ledges 62 which are support ledges for a tray 64. The tray 64 is a generally rectangular tray with opposite end walls 66 and 68. The end walls 66 and 68 include upward extensions 70 connected with or terminating to a curved handle 72 to facilitate removal of the tray 64 from within the bin 10. The end walls 66 and 68 are connected by side walls 74 and 76. The side walls 74 and 76 define edges such as edge 78 for side wall 76. The edge 78 rests upon the ledges of 62 so that the tray 64 will thus be supported. The edge 80 associated with the side wall 74 rests against the top of the wall 44 associated with the recess 40. Thus the tray 64 is fully supported within the bin 10.

The lid 12 includes depending end walls 90 and 92 and a depending back wall 94 as well as a depending front wall 96. The walls 90, 92, 94 and 96 are connected and may diverge or may be generally perpendicular to the top or lid 14. The walls 90, 92, 94 and 96 include a peripheral flange 98 which rests or engages on the peripheral rim 35 defined by the lower bin 10 and/or container 50. Rim 98 includes a depending rib 99 which facilitates alignment of lid 12 on bin 10 and also helps seal the interior of bin 10 from dirt. A strike 100 is defined in the end walls 90, 92 for cooperation with the latch 36. A hinge leaf 102, associated with end wall 94, cooperates with or is pinned by a hinge pin 105 with a hinge leaf 104, associated with the back wall 30, so that the lid 12 may be hinged to the bin 10. When the lid 12 is in the closed position, the flange 98 fits against the peripheral rim 35 and also engages with the container 50 to hold the container 50 in place. Further, the inside of the top of the lid 12 engages against the handles 68 and 72 to hold the tray 64 in position within the bin 10. The inside of the lid 12 includes an array of molded reinforcing ribs 103.

The latch 36 is an over center acting plastic latch construction similar to that shown in U.S. Pat. No. 5,518,139 which is incorporated herewith by reference. A series of matched openings such as openings 106, 107 associated with the latch and the strike respectively enable insertion of a padlock, for example, to lock the box.

In operation, the tool box may be open and filled with tools. Lid 12 may then be closed and latched for tool transport and storage. When closed, the box may be used as a seat or support stand. Because the box may be entirely enclosed, tools will tend to lend stability to the box as a support stool for standing or sitting. To gain access to the interior of the bin 10, of course, the latches 36 must be released and the lid 12 moved about the hinge axis. The tray 64 and container 50 may then be removed as desired. Also, it should be noted that the particular design of the tray 64, as well as the design of the containers 50, may be varied. The number of containers 50 may be altered or varied. Additionally, it is noted that a rectangular opening is provided in the back wall 30 for receipt of a beam, such as a 2 by 4 or the like, again for supporting the tool box or for utilizing the tool box as the basis for a support platform.

It is possible to vary the configuration of the tool box as well as the arrangement of trays, compartments and the like without departing from the spirit and scope of the invention. The invention, therefore, is to be limited only by the following claims and their equivalents.

What is claimed is:

1. A tool box comprising, in combination:

a lower bin having a generally rectangular bottom wall, opposite end walls projecting upwardly from the bottom wall and a front wall and a back wall also projecting upwardly from the bottom wall;

the front wall and the back wall converging toward one another, said front wall and said back wall connected by the end walls to form said lower bin with the bottom wall, said lower bin having an open top;

the connected walls defining a peripheral rim section for the lower bin;

a top lid having a generally rectangular top lid wall, opposite depending end walls, a depending front wall and a depending back wall, said depending front wall and back wall of the top lid connected together by said depending end walls of the top lid to define a peripheral flange section which fits against the peripheral rim section of the lower bin to thereby support the top lid on the lower bin, said bottom wall of the lower bin and the top lid wall of the top lid being generally parallel when the top lid is positioned on the lower bin with the peripheral flange section fitted against the peripheral rim section; and a hinge mechanism connecting one of the depending walls of the top lid with an upwardly projecting wall of the lower bin to permit the top lid to be pivoted from covering the lower bin, said top lid wall having a lesser area than the bottom wall of the lower bin and positioned within the profile of the bottom wall of the lower bin when the top lid is closed upon the lower bin.

2. The tool box of claim 1 wherein the end walls of the bin converge together in the direction of the peripheral rim section.

3. The tool box of claim 1 wherein the peripheral rim section of the lower bin supports the peripheral flange section of the top lid when the top lid is closed upon the lower bin, and said peripheral flange section including a depending rib projecting downwardly from the peripheral flange section for positioning the top lid upon the lower bin.

4. The tool box of claim 1 wherein the lid top wall includes an outside surface which is flat.

5. The tool box of claim 1 wherein the lid top wall further includes a recessed handle.

6. The tool box of claim 1 wherein the lid top wall has an inside surface including a pattern of reinforcing ribs on the inside surface.

7. The tool box of claim 1 further including a tray in the form of a rectangular pan with a bottom wall, and side walls, said pan tray side walls including a peripheral flange section, said peripheral flange section of said tray engageable with the peripheral rim section of the lower bin to support the tray within lower bin.

8. The tool box of claim 1 including at least one latch member for connecting the lid to the bin.

9. The tool box of claim 7 including a latch member, said latch member including a catch for engaging the top lid and thereby retaining the peripheral flange section of the tray between the top lid and lower bin when the top lid is closed on the lower bin.

10. The tool box of claim 1 wherein the lower bin includes a storage container having a bottom wall and container side walls projecting upwardly from the container bottom wall, said storage container having a lower nesting rim, said bin including a receptacle opening for receipt of the container and support of the nesting rim, said container defining part of the front wall of the lower bin when positioned in the receptacle opening and further defining part of the peripheral rim section for the lower bin.

11. The tool box of claim 10 in further combination with a tray, said tray defining a receptacle extending between the end walls of the lower bin, said tray having opposite end walls slidably positioned within the opposite end walls of the lower bin, said tray end walls each including an upstanding side wall extension with a lateral handle projection, whereby the tray may be manually engaged to lift the tray from the bin.

12. The tool box of claim 10 in further combination with a tray, said tray defining a receptacle extending between the end walls of the lower bin, said tray having opposite end walls opposed to the end walls of the lower bin, said tray opposite end walls connected by side edge walls of the tray, said lower bin including a tray support ledge along at least one of the back wall and front wall on the inside of the bin for supporting the tray.

13. The tool box of claim 12 further including a container having a bottom and container side walls, said lower bin including a pocket for receipt of the container, said container including a top edge of a side wall, said side edge wall of the tray overlying the top edge of the side wall of the container when the container and tray are positioned in the lower bin to thereby hold the container in the lower bin.

14. The tool box of claim 1 further including a rectangular recess in the front wall of the lower bin for receipt of a support beam member.

15. The tool box of claim 1 further including a rectangular recess in the back wall of the lower bin for receipt of a support beam member.

* * * * *